United States Patent [19]

Tansuwan

[11] 4,300,205

[45] Nov. 10, 1981

[54] AUTOMATIVE ENGINE SIMULATING APPARATUS

[75] Inventor: Chusak Tansuwan, St. Louis, Mo.

[73] Assignee: ACF Industries, Inc., New York, N.Y.

[21] Appl. No.: 137,830

[22] Filed: Apr. 7, 1980

[51] Int. Cl.[3] ..... G06G 7/70

[52] U.S. Cl. ..... 364/578; 364/431; 364/424; 364/551

[58] Field of Search ..... 364/551, 424, 431, 579, 364/553; 367/580, 578; 73/116, 117.1, 117.3

[56] References Cited

U.S. PATENT DOCUMENTS

| | | | |
|---|---|---|---|
| 3,719,812 | 3/1973 | Bishop et al. | 364/579 |
| 4,116,052 | 9/1978 | Paluka | 364/431 X |
| 4,231,092 | 10/1980 | Grob et al. | 364/431 |
| 4,234,921 | 11/1980 | Kinoshita et al. | 364/551 X |

*Primary Examiner*—Edward J. Wise

*Attorney, Agent, or Firm*—J. Joseph Muller

[57] ABSTRACT

Apparatus for simulating the operating characteristics of an automobile engine. The ignition system of the engine is electrically simulated and an electrical signal representative of engine revolutions per minute under various engine operation conditions is generated. A transfer function derived for the engine is implemented to control generation of the electrical signal. Engine acceleration and deceleration is simulated. An oxygen sensor normally positioned in an exhaust system of the engine is simulated with an electrical signal representative of an output signal supplied by the oxygen sensor being generated. Operation of a first electromechanical device controlled by an engine control sysem is simulated as is the operation of a second electromechanical device. The apparatus is useful for testing and calibrating a feedback and automatic idle speed control system for the automobile.

24 Claims, 5 Drawing Figures

AUTOMATIVE ENGINE SIMULATING APPARATUS

BACKGROUND OF THE INVENTION

This invention relates to simulators and, more specifically, to an apparatus for simulating the operating characteristics of an internal combustion automobile engine.

In U.S. patent application Ser. No. 108,495 filed Dec. 31, 1979, and assigned to the same assignee as the present application, there is described an automatic idle speed (AIS) control apparatus for use on an internal combustion engine of the type commonly found in automobiles. In U.S. patent application Ser. No. 108,496, also filed Dec. 31, 1979, and assigned to the same assignee as the present application, there is described development apparatus for a fuel control system for an automobile engine. The apparatus described in this latter application is used to simulate the apparatus described in the former application, thus to facilitate development of the control apparatus. In practice, the development apparatus is installed on an automobile to verify the operational strategy of the control apparatus and improve its performance. The control apparatus itself is intended for permanent installation on an automobile to both automatically control engine idle speed and the air-fuel ratio of a mixture produced in a carburetor installed on the engine and supplied to the engine for combustion.

The control apparatus is intended for use with a multiplicity of engines which may have 4, 6, or 8 cylinders. Because of the time and expense involved in obtaining a variety of multi-cylinder engines with which to test the control apparatus and, because of the time and expense involved in installing and removing the control apparatus on the engines for test, modification or checkout, a test and development tool is needed which can be conveniently used in a laboratory to interface with the control or development apparatus. Such a test tool must be capable of simulating each of the many types of engines with which the control apparatus is used.

SUMMARY OF THE INVENTION

Among the several objects of the present invention may be noted the provision of apparatus for simulating the operating characteristics of an automobile engine; the provision of such apparatus for simulating engine starting, driving, acceleration and deceleration characteristics; the provision of such apparatus for simulating these characteristics for a variety of engines having a different number of cylinders; the provision of such apparatus for simulating sensors installed on an engine; the provision of such apparatus for simulating various servomechanical devices used with the engine to control its operation; the provision of such apparatus for interfacing with development and production systems which control the operation of the servomechanical devices in response to sensed engine operating parameters; and, the provision of such apparatus which readily interfaces with such systems and is easy to operate.

Briefly, apparatus of the present invention simulates the operating characteristics of an automobile engine and comprises a starting means electrically simulating the ignition system of the engine. Means are provided for generating an electrical signal representative of engine revolutions per minute under various engine operating conditions. A control means controls the signal generating means, the control means simulating a transfer function derived for a specific engine. A speed means simulates engine acceleration and deceleration. A sensor simulating means simulates operation of an oxygen sensor normally positioned in an exhaust system of the engine and generates an electrical signal representative of an output signal supplied by the oxygen sensor. A first servo means simulates the operation of a first electromechanical device controlled by an automobile engine control system and a second servo means simulates the operation of a second electromechanical device controlled by the automobile engine control system. The apparatus is useful for testing and calibrating a feedback and automatic idle speed control system for the automobile. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
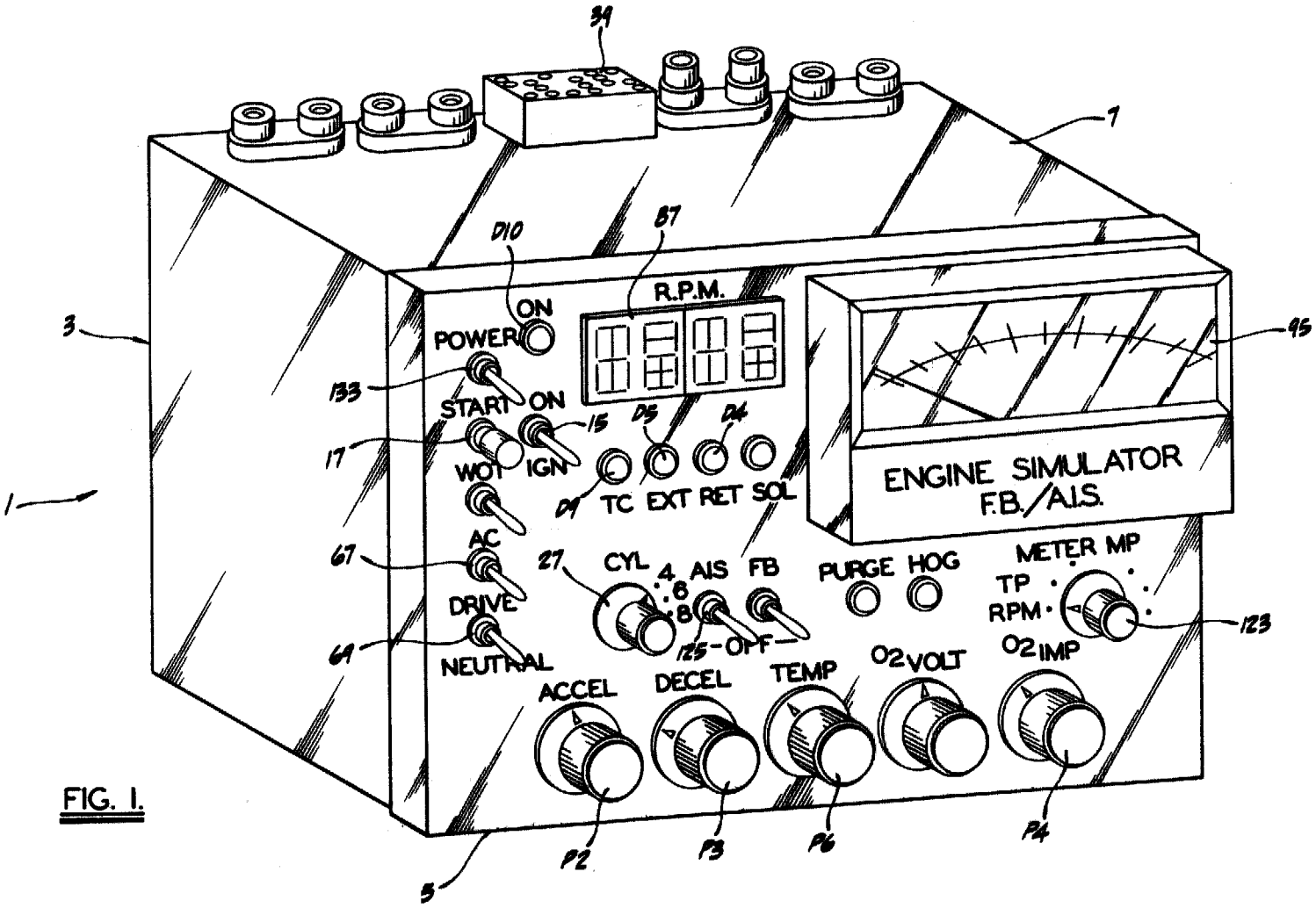
FIG. 1 is a perspective view of an automobile engine simulating apparatus of the present invention.

Referring to the drawings, apparatus of the present invention for simulating the operating characteristics of an automobile internal combustion engine is indicated generally 1 in FIG. 1 and includes a portable housing or case 3 in which is housed electrical circuitry to be described hereinafter. Case 3 has a front panel 5 on which are mounted various controls and displays and a top panel 7 on which are mounted appropriate electrical connectors for readily interfacing the apparatus with an automobile engine control system such as that described in U.S. patent application Ser. No. 108,495, filed Dec. 31, 1979, and assigned to the same assignee as the present application. Alternately, apparatus 1 is readily interfaced with development apparatus such as that described in U.S. patent application Ser. No. 108,496, also filed Dec. 31, 1979, and assigned to the same assignee as the present application.

Figure 2:
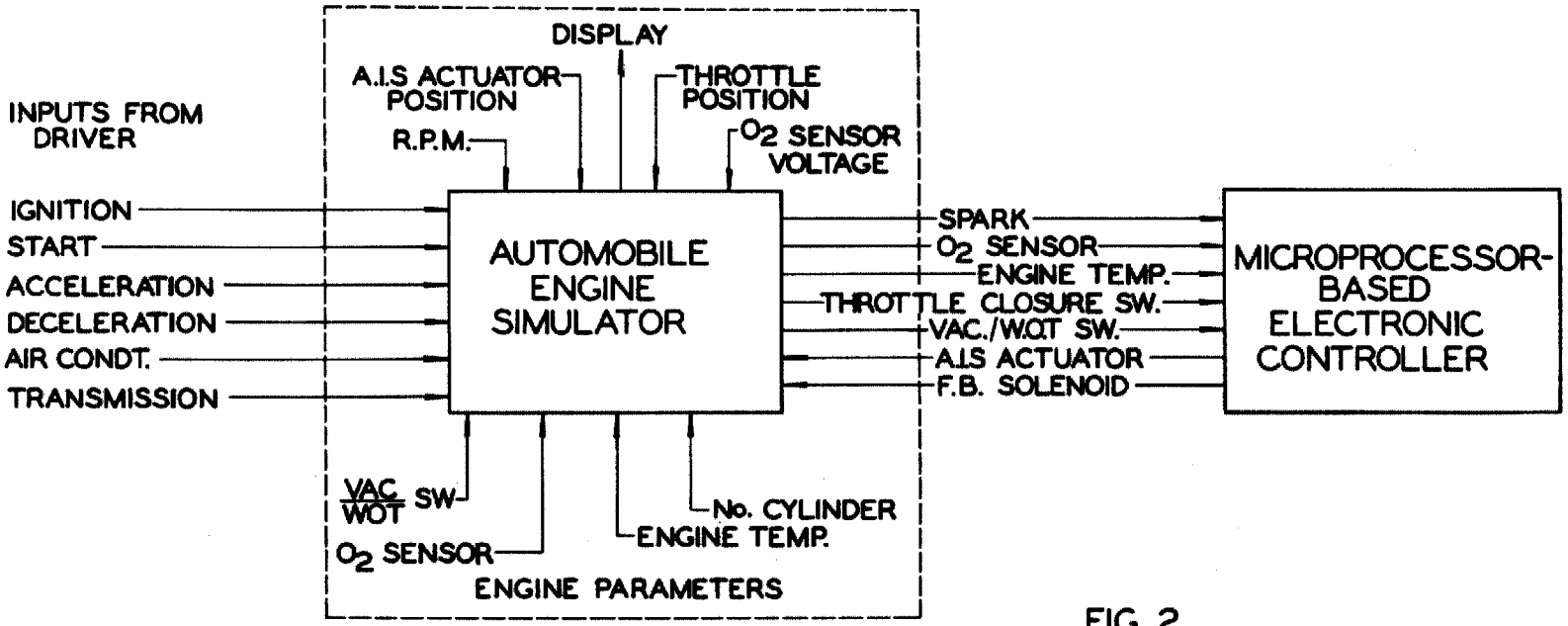
FIG. 2 is a block diagram illustrating the interface between the apparatus of the present invention and an automobile engine control system.

The function of apparatus 1 is best described with reference to FIG. 2. For a given automobile, a driver performs the following functions: He inserts his key into the ignition switch for the engine and starts it. He engages the automobile's transmission and accelerates away from the vehicle's parked position. Thereafter, he accelerates and decelerates the vehicle during his normal course of driving. In addition, he may place an auxiliary load such as an air conditioner on the engine. The engine has a given number of cylinders and after it has started, heats up to a nominal running temperature which is monitored by an appropriate sensor. The engine runs over a wide range of speeds denoted as revolutions per minute, or r.p.m. In addition, the engine has an associated carburetor with a throttle value which opens and closes as the driver speeds up or slows down the engine. Under heavy accelerations, this throttle is at its wide open position. This condition is sensed by a vacuum switch located in the intake manifold of the engine. The engine further has an associated oxygen or $O_2$ sensor which senses the amount of oxygen in the exhaust products of the engine and produces an electrical signal representative thereof. The engine may also have a feedback solenoid for controlling the air-fuel ratio of the mixture produced in the carburetor and combusted in the engine as well as an automatic idle speed (AIS) actuator for controlling engine idle speed. These latter components are servomechanical devices whose function is to aid in controlling engine emissions so they meet prescribed emission standards as well as tamperproofing requirements.

A microprocessor-based electronic controller such as that described in the above-mentioned application, Ser. No. 108,495, receives various inputs from the engine and its associated sensors, processes the information contained therein and generates control signals which are supplied as outputs from the controller to the servomechanical devices. These signals control operation of the devices. A transfer function is derived for each engine with which the controller is used and the processing of information by the controller is accomplished with reference to this transfer function. Because engines differ as to their number of cylinders, cubic inch displacement, etc., the transfer function for one engine differs from that for another engine.

Apparatus 1 of the present invention is useful in that it can be configured to simulate the operating characteristics of any number of different type engines and interface with a controller to provide the controller input signals identical to those provided by the sensors of a real engine. In addition, apparatus 1 manipulates control signals generated by the controller to simulate responses similar to those produced by servomechanical devices associated with the engine. The apparatus simulates the transfer function for the engine in order to provide engine response to various driver actions (i.e. stepping on the accelerator or brake, putting the engine in gear, etc.). As a consequence, the apparatus effectively tests a controller's performance prior to its installation on an engine.

The apparatus is also useful in developing the above-mentioned controller. The development apparatus described in U.S. patent application Ser. No. 108,496 simulates the operation and response of a controller. By interfacing apparatus 1 of the present invention with this development apparatus, various changes and improvements to the controller strategy can be tested in the laboratory to determine how they effect controller performance.

Figure 3:
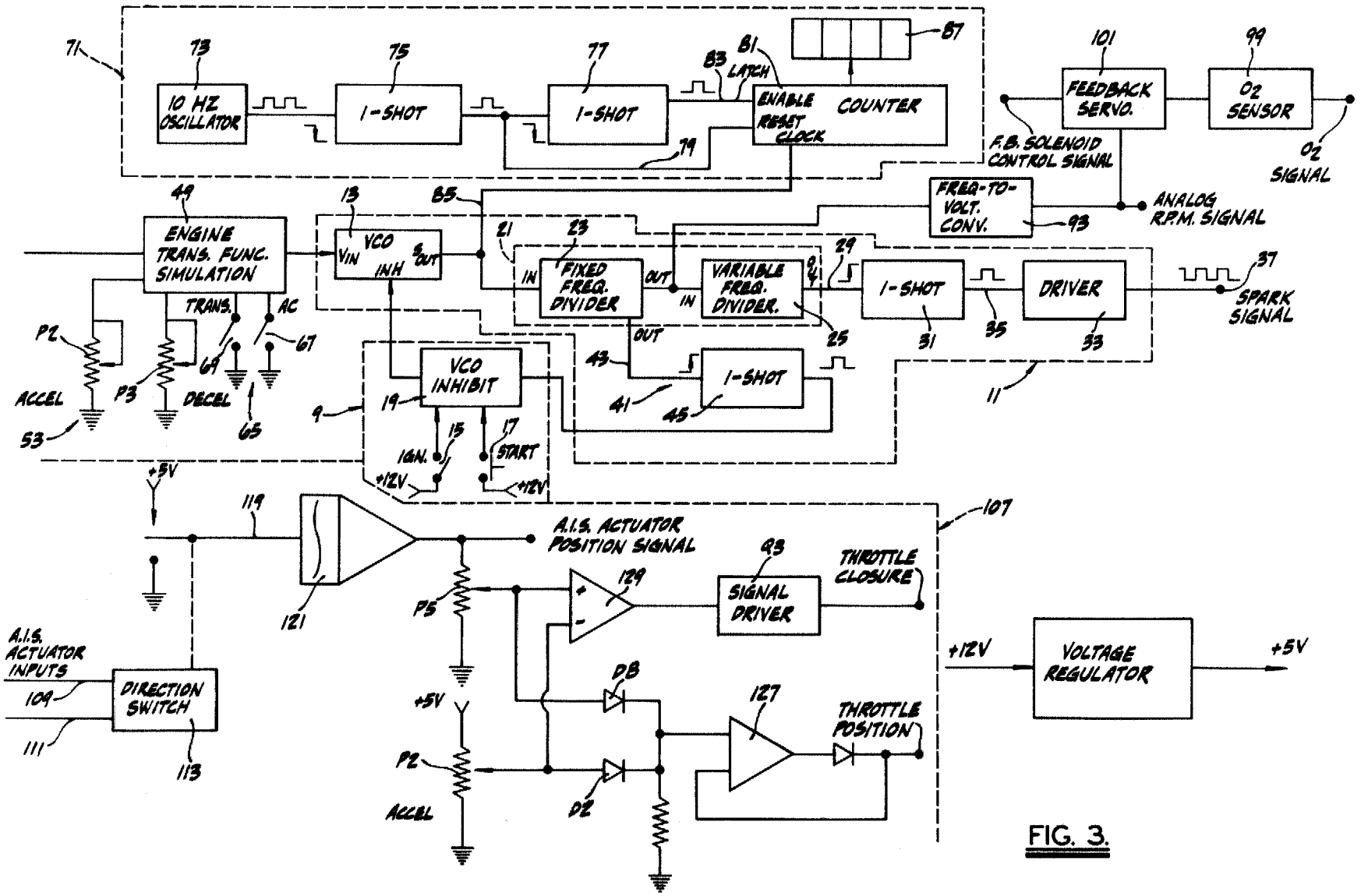
FIG. 3 is a block diagram of electrical circuitry employed in the apparatus of the present invention.
Figure 4A:
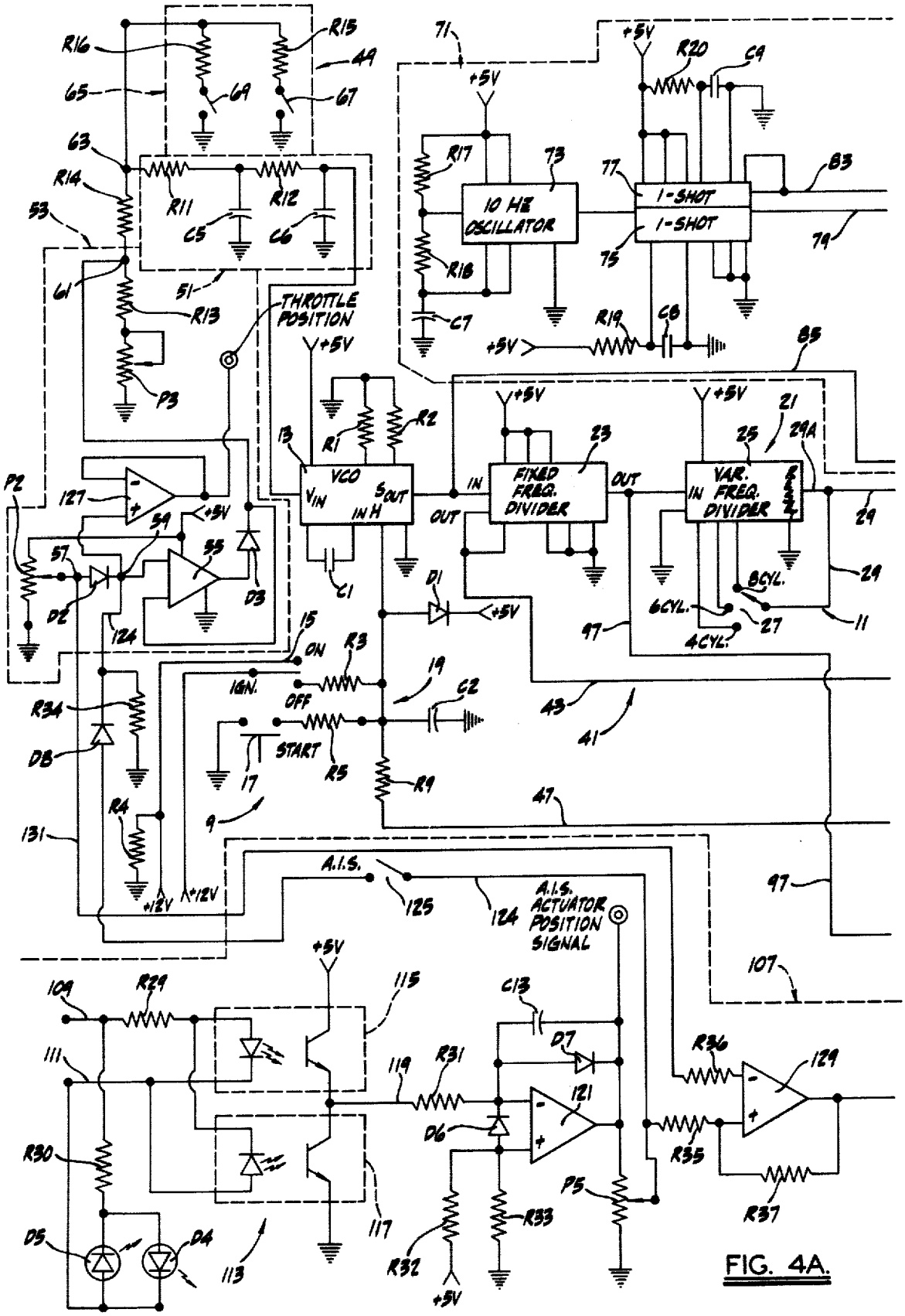
FIGS. 4A and 4B are schematic circuit diagrams of the electrical circuitry used in the apparatus.

Referring to FIGS. 3 and 4A, apparatus 1 comprises a starting means 9 simulating the ignition system of an engine and a means 11 for generating an electrical signal representative of engine revolutions per minute (r.p.m.) under various engine operating conditions. Means 11 includes a voltage controlled oscillator (VCO) 13 which is a linear VCO of the type manufactured by National Semiconductor Corporation of Santa Clara, Calif. under the part designation CD4046B. Oscillator 13 produces an output signal whose frequency is determined by the amplitude of a voltage applied to a Vin input of the oscillator as well as by the values of a resistor R1, a resistor R2, and a capacitor C1.

Ignition means 9 includes an ignition switch 15 and a start pushbutton 17, both of which are located on front panel 5 of the apparatus. In addition, the ignition means includes an inhibit circuit 19 to disable oscillator 13 when ignition switch 15 is in its OFF position. Circuit 19 includes a resistor R3 interposed between a voltage source and an inhibit input INH of the oscillator. A capacitor C2 acts as a noise filter. A voltage clamping diode D1 limits the level of the voltage applied to this input to within the supply level, for example, +5 volts. This voltage is supplied to the inhibit input of the oscillator so long as switch 15 is in its OFF position. This creates a logic high at the inhibit input of the oscillator and this logic high disables the oscillator. When ignition switch 15 is moved to its ON position the voltage providing the logic high to the inhibit input is removed. However, until pushbutton 17 is depressed, the logic high is maintained at the inhibit input of oscillator 13 even though switch 15 is on. When start pushbutton 17 is depressed, the inhibit input of VCO 13 is grounded through the pushbutton and a resistor R5 and thus is made a logic low. This enables the oscillator. The frequency or repitition rate of the signal supplied at the output (S out) of oscillator 13 is several times higher than an engine spark signal whose frequency is proportional to the speed or r.p.m. of an engine. The spark signal is an electrical signal developed off the negative side of the primary coil of the ignition system.

Means 11 includes a means 21 for changing frequency of the electrical signal from oscillator 13 so the resultant signal, at any one time, represents the spark signal of one of a plurality of multi-cylinder engines. The signal from oscillator 13 is supplied as an input to a first frequency divider 23, this frequency divider being commercially available from National Semiconductor Corporation of Santa Clara, Calif. under the designation CD4518. Divider 23 has a fixed divisor so, for example, to divide the frequency of the input signal by a factor of 50. The signal from fixed frequency divider 23 is supplied to input of a variable frequency divider 25. Frequency divider 25 is available commercially from National Semiconductor Corporation of Santa Clara, Calif. under the designation CD4017. The divisor or division factor of divider 25 is determined by a multiposition switch 27 located on front panel 5 of the apparatus. Switch 27 is a three-position switch settable to either a 4 cylinder, 6 cylinder, or an 8 cylinder position. For each separate setting, divider 25 divides the frequency of the input signal provided to it by a different division factor. Thus, for example, when switch 27 is set to the 8-cylinder position, the division factor is 3; when set to the 6-cylinder position, division factor is 4; and when set to the 4-cylinder position, the division factor is 6. Switch 27 is connected to a signal line 29 and a branch 29A of this line is connected to a reset input of divider 25. Thus, the divider is reset by each element of the output signal developed by it.

Means 11 further includes a monostable multivibrator or "1-shot" 31 and a driver 33 (see FIGS. 3 and 4B) which are respectively used to shape the electrical signal on line 29 and as an output stage for supplying the electrical signal as an output representative of the spark signal of the engine. Multivibrator 31 is commercially available from National Semiconductor Corporation of Santa Clara, Calif. under their model designation MC14528. The 1-shot is triggered by the leading edge of a signal element on line 29 and produces square wave signal element on a line 35. The width of each signal element is determined by the values of a resistor R6 and a capacitor C3. The signal elements supplied on line 35 are applied to the base of an NPN transistor Q1 through a base resistor R7. When the logic level of the signal on line 35 is low, transistor Q1 is off and +12 volts are provided through a resistor R8 to a pin 37 in a connector 39 mounted on top panel 7 of the apparatus. When the logic level of the signal on line 35 is high, transistor Q1 is on and pin 37 is grounded through the transistor. As a result, an electrical signal is produced at pin 37 whose frequency or pulse repetition rate is used to determine engine speed.

Figure 4B:
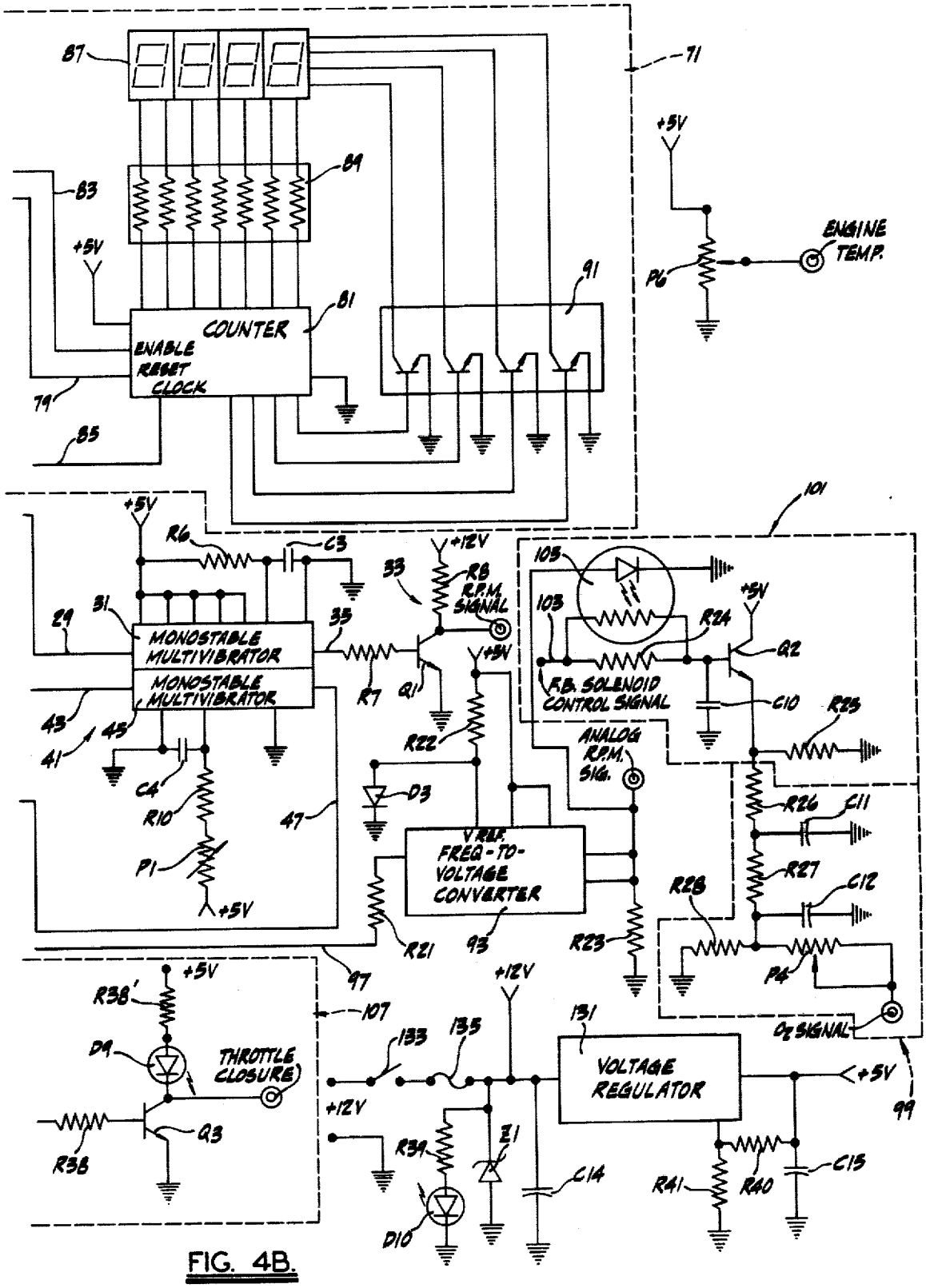

It sometimes occurs that an engine is subjected to a load so excessive that engine speed falls off to the point where the engine dies and has to be restarted. To simulate this, means 11 further includes a means 41 which measures the period of time between elements of the signal generated by oscillator 13 and inhibits the oscillator if the period exceeds a predetermined period. At increase in time between signal elements is indicative of decreasing engine speed and the predetermined time period represents the lower limit of engine speed below which the engine dies. Referring to FIGS. 4A and 4B, the module in which divider 23 is incorporated includes a separate counter circuit responsive to elements of the signal generated by oscillator 13 and the output of this counter is supplied on a line 43 to the input of a retriggerable monostable multivibrator or 1-shot 45. This multivibrator is contained in the same module as multivibrator 31. The output of 1-shot 45 is supplied on a line 47, via a resistor R9, to the inhibit input of oscillator 13. The logic level of this output is maintained low so long as the time period between signal elements applied to its input is less than a predetermined period. This predetermined time period is established by the values of a capacitor C4 and a resistor R10, and the setting of a potentiometer P1. If the time period between signal elements on line 43 exceeds the period established by these circuit elements, the logic level on line 47 is switched from low to high and this inhibits operation of oscillator 13. Further, it is the logic high from 1-shot 45 which maintains VC013 inhibited when ignition switch 15 is moved from OFF to ON and before pushbutton 17 is depressed.

Apparatus 1 next includes a control means indicated generally 49 for controlling the operation of signal generating means 11. Control means 49 comprises a resistor-capacitor (R-C) network 51 which effectively simulates a transfer function for a particular engine. The network includes series-connected resistors R11 and R12; a capacitor C5 connected between the junction of resistors R11 and R12 and electrical ground and a capacitor C6 connected between resistor R12 and the voltage input Vin of oscillator 13 and electrical ground. The values of these resistors and capacitors are determined in accordance with the transfer function derived for the engine being simulated and, therefore, the values vary from one simulated engine to another. The output of the network is a voltage supplied to oscillator 13. The amplitude of this voltage determines the frequency of the output signal supplied by the oscillator.

The apparatus also includes a speed means 53 for simulating engine accelerations and decelerations. Engine acceleration control is simulated by a variable potentiometer P2 connected between a voltage source and electrical ground. The wiper arm of the potentiometer is connected to the input of an operational amplifier (op-amp) 55 through a switching diode D2. The anode of diode D2 is connected to the wiper arm at a junction point 57 and the cathode of the diode is connected to the amplifier at a summing point 59. Op-amp 55 functions as an amplifier and the amplifier output is supplied to a junction point 61 through a diode D3. It should be noted that the acceleration potentiometer P2 setting simulates the position of the accelerator pedal rather than the rate of engine acceleration.

Speed means 53 also includes a potentiometer P3 for varying the decay rate of the output voltage of network 51, thus simulating the rate of engine deceleration. Potentiometer P3 is series connected with a resistor R13 between junction 61 and electrical ground. The voltage developed at junction 61 is impressed on network 51 via a resistor R14. This resistor is connected between junction 61 and a junction point 63 which is the input to network 51. Potentiometer P2 and P3 are both mounted on front panel 5 of the apparatus and are independently adjustable.

In addition to the above-described speed means 53, apparatus 1 further includes a load means 65 for simulating loads placed on the engine. Means 65 includes a resistor R15 connected to junction 63 and a switch 67 connected between the resistor and electrical ground. Switch 67 is located on front panel 5 of the apparatus and when closed places resistor R15 in the electrical circuit with network 51. Resistor R15 represents an air conditioner load placed on the engine when switch 67 is closed. A resistor R16 is also connected to junction 63 and a switch 69 is connected between this resistor and electrical ground. Switch 69 is also located on front panel 5 of the apparatus. Resistor R16 represents a transmission load placed on the engine when switch 69 is closed. This is the DRIVE position of the switch. When the switch is open, no transmission load is simulated. This is the NEUTRAL position of the switch. It will be understood that other engine loads may be simulated in a similar manner to those described.

Apparatus 1 includes a display means 71 for providing a visual indication of the simulated engine's operating speed or revolutions per minute. An oscillator 73 generates a 10 Hz. signal, the frequency of this signal being determined by the values of a resistor R17, a resistor R18, and a capacitor C7. Oscillator 73 is commercially available from National Semiconductor Corporation of Santa Clara, Calif. under the part designation LM555. The 10 Hz signal is successively applied to a monostable multivibrator or 1-shot 75 and a 1-shot 77 (see FIG. 3). As with 1-shots 31 and 45 previously described, 1-shots 75 and 77 are combined on a single chip module which is available from the same source under the same part designation. The width of the pulse produced by 1-shot 75 is determined by the values of a resistor R19 and a capacitor C8, while that of 1-shot 77 is determined by the values of a resistor R20 and a capacitor C9. A pulse produced by 1-shot 75, besides being supplied to 1-shot 77 is also supplied on a line 79 to a RESET input of a counter 81. A pulse produced by 1-shot 77 is supplied on a line 83 to an ENABLE input of the counter. Elements of the electrical signal generated by variable frequency oscillator 13 are supplied to a clock input of the counter on a line 85.

Counter 81 is enabled to count the number of signal elements in the electrical signal generated by oscillator 13 ten times a second, this corresponding to the operating frequency of oscillator 73. The contents of counter 81 are displayed by a four-digit LED display 87 located on front panel 5 of the apparatus. The contents of counter 81 are supplied to display 87 via a resistance module 89. A driver 91 comprising NPN transistors is actuated to provide an electrical ground for the display.

In addition to the above-described digital display, the apparatus also includes a means 93 for converting the frequency of the signal produced by voltage control oscillator 13 to a voltage. This voltage is then supplied to either a meter 95 located on front panel 5 of the apparatus or to an external strip chart recorder or other external recording device. The output signal from fixed frequency divider 23 is supplied on a line 97, via a resistor R21, to the input of frequency-to-voltage converter 93. Converter 93 is available from National Semiconductor Corporation of Santa Clara, Calif. under the part designation LM2907. A reference voltage is applied to the converter via a resistor R22 and a diode D3 is connected between the resistor and the converter input and electrical ground. The electrical output of the converter is an analog voltage whose amplitude is a function of engine r.p.m. A load resistor R23 is connected between the converter output and electrical ground.

Apparatus 1 next includes a sensor simulating means 99 for simulating operation of an oxygen sensor normally positioned in an exhaust system of an engine. In addition, a first servo simulating means 101 simulates operation of a first servo-mechanical device controlled by a control system for the automobile engine. Such an engine control system is described is the previously referenced U.S. patent applications and includes the microprocessor-based electronic controller discussed with reference to FIG. 2. Means 101 simulates operation of a feedback solenoid used to control the air-fuel ratio of a mixture produced by a carburetor mounted on an engine and supplied to the engine for combustion therein. As previously noted, the controller utilizes an electrical signal developed by the oxygen sensor to generate a control signal supplied to the feedback solenoid to control its operation and vary the air-fuel ratio of the mixture.

The feedback solenoid control signal is a pulsed signal input to apparatus 1, via connector 39, and is supplied on a line 103 to the base of an NPN transistor Q2. This signal is applied via an R-C network comprising a resistor R24, a capacitor C10, and an optically controlled resistor 105 connected in parallel with resistor R24. A resistor R25 comprises a load resistor for transistor Q2.

The input to the optically controlled resistor is the analog voltage signal produced by converter 93 and is used to modify the time constant of the r-c network. As simulated engine r.p.m. increases, the amplitude of the voltage produced by converter 93 increases. This, in turn, intensifies the magnitude of the light generated within resistor 105 and lowers the effective resistance of the resistor. This lowers the overall time constant of the r-c network. The overall result is to vary the response of transistor Q2 to the feedback control signal on line 103, thus for the transistor to switch on and off at a rate which varies as a function of engine r.p.m.

Oxygen sensor simulating means 99 includes a resistor R26 connected in parallel with resistor R25. A capacitor C11 is connected between resistor R26 and electrical ground. A resistor R27 is series-connected with resistor R26 and a capacitor C12 is connected between resistor R27 and electrical ground. This r-c network is connected to a resistor R28 and a potentiometer P4. This potentiometer is located on front panel 5 of the apparatus and is used to vary the overall impedance of the sensor simulating circuit. To simulate an initial operating condition, when the simulated oxygen sensor is cold, potentiometer P4 is adjusted so the overall sensor impedance is high. To simulate an operating condition representing a hot sensor, the condition of the sensor after an engine has been running a short while, the potentiometer is adjusted so the overall simulated sensor impedance approximates that of a sensor heated by the hot gases exhausted from the engine. The resultant electrical signal produced is supplied, via connector 39, to the mircoprocessor-based electronic controller represented in FIG. 2.

Apparatus 1 additionally includes a second servo simulating means 107 for simulating a second servomechanical device controlled by the automobile control system. Means 107 simulates operation of an automatic idle speed (AIS) actuator such as one described in U.S. patent application Ser. No. 108,497, filed Dec. 31, 1979, and assigned to the same assignee as the present application. As described in this application, the actuator includes a reversible d.c. motor which, when driven in the appropriate direction, extends or retracts a member contacting a throttle lever of a carburetor installed on an engine. In addition, a switch is incorporated in the member and this switch is actuated when the carburetor throttle is closed. Extension or retraction of the member is done in accordance with a control signal developed by the engine control system to control engine idle speed. Two signal lines are routed from the engine controller to the d.c. motor. When the motor is to be driven in one direction, one line is made high with respect to the other and the opposite situation is created when the motor is to be driven in the opposite direction.

Referring to FIGS. 3 and 4A, the two lines from the engine controller are indicated 109 and 111 respectively. When line 109 is high with respect to line 111, the AIS actuator is retracted and when line 111 is high with respect to line 109, the actuator is extended. A directional switch 113 includes a pair of photon isolated couplers 115 and 117 respectively. These couplers are commercially available from the General Electric Company under their designation H11A1. Lines 109 and 111 are connected to inputs of each coupler, line 109 being so connected through a resistor R29. In addition, each line is connected to a pair of light-emitting diodes D4 and D5 respectively. Both LED's are mounted on front panel 5 of the apparatus with diode D4 being illuminated when actuator retraction is simulated and diode D5 being illuminated when actuator extension is simulated. Line 109 is tied to these diodes through a resistor R30. When line 109 is high with respect to line 111, simulating a retract condition, coupler 115 is energized. A voltage is then applied on a line 119, through a resistor R31, to one input of an operational amplifier 121. When line 111 is high with respect to line 109, simulating an extend condition, line 119 is grounded.

Line 119 is connected to the inverting input of the op-amp. A voltage divider comprising resistors R32 and R33 develops a voltage applied to the noninverting input of the op-amp and a diode D6 is connected across the op-amp inputs. A capacitor C13 is connected between the op-amp output and its inverting input and a diode D7 is connected in parallel with this capacitor. Op-amp 121 functions as an integrator to produce a ramp output of decreasing amplitude when a retract condition is simulated. The integration or ramp rate of the integrator is determined by the values of resistor R31 and capacitor C13. The amplitude of the integrator output signal is indicative of the position of the actuator member and this signal is displayed on meter 95 by setting a meter control switch 123 (see FIG. 1) to the appropriate position.

The electrical signal output of integrator 121 is further provided to a potentiometer P5 which is a scaling potentiometer whose setting adjusts the amplitude of the signal to a range of values compatible with those applied to the circuit 51 previously described. The resultant signal is supplied via a line 124 to summing point 59. An AIS switch 125 is positioned in line 124. Switch 125 is located on front panel 5 of the apparatus and when closed, closes the circuit path from integrator 121 to the summing point. A switching diode D8 is placed in line 124 between switch 124 and the summing point and a resistor R34 is connected between the cathode of diode D8 and electrical ground. With switch 125 closed, the instantaneous voltage level of the scaled output signal from integrator 121 is combined, at summing point 59, with the voltage developed across acceleration potentiometer P2. The resultant voltage is applied to op-amp 55 and the resultant signal supplied by the op-amp to circuit 51 is thus a function of both engine acceleration and AIS actuator position. In addition, the resultant voltage at summing point 59 is applied to an operational amplifier 127 which functions as a buffer amplifier. The output of op-amp 127 is a signal whose amplitude is representative of carburetor throttle position. This signal is also displayed on meter 95 by properly setting switch 123.

The signal developed by potentiometer P5 is further supplied to the noninverting input of an operational amplifier 129 via a resistor R35. Op-amp 129 functions as a comparator and its other input is the voltage developed by acceleration potentiometer P2 at junction 57. This voltage is applied to op-amp 129 via a line 131 which includes a resistor R36. A resistor R37 is in a feedback loop from the output of the comparator to its noninverting input. The logic output of comparator 129 is applied to the base of an NPN transistor Q3 through a resistor R38. The function of comparator 129 is to determine whether a carburetor throttle is under control of an AIS actuator or the driver of the vehicle by means of the accelerator pedal. When the logic output of comparator 129 is high, transistor Q3 is turned on. At this time, a ground path is provided for a light emitting diode D9 located on front panel 5 of the apparatus. Voltage to the diode is provided through a resistor R38 and illumination of the diode indicates the carburetor throttle is closed. This information is further provided as an output to the microprocessor-based electronic controller via connector 39.

A potentiometer P6 located on front panel 5 of the apparatus is used to generate a voltage representing engine temperature. The potentiometer is connected between a voltage source and electrical ground and the wiper arm of the potentiometer is tied to a pin in connector 39. By adjusting the setting of potentiometer P6, the simulated engine temperature is varied.

Power for the above-described circuitry is provided by a voltage regulator 131. When a power switch 133 on front panel 5 is placed to ON, +12 volts is applied to the voltage regulator. The voltage input path includes a fuse 135, a 16 volt zener diode Z1, and a filter capacitor C14. Upon closure of switch 133, voltage is applied to a light-emitting diode D10 via a resistor R39. Diode D10 provides a power-on indication on front panel 5 of the apparatus. The voltage output of regulator 131 is set to +5 v d.c. by the values of a resistor R40 and a resistor R41. This voltage is filtered by a filter capacitor C15.

In view of the above, it will be seen that the several objects of the invention are achieved and other advantageous results obtained.

As various changes could be made in the above constructions without departing from the scope of the invention, it is intended that all matter contained in the above description and shown in the accompanying drawings shall be interpreted as illustrative and not in a limiting sense.

What is claimed is:

1. Apparatus for simulating the operating characteristics of an automobile engine comprising:

starting means for electrically simulating the ignition system of the engine;

means for generating an electrical signal representative of engine revolutions per minute under various engine operating conditions;

control means for controlling the signal generating means, the control means simulating a transfer function derived for the engine;

speed means for simulating engine acceleration and deceleration;

sensor simulating means for simulating the operation of an oxygen sensor normally positioned in an exhaust system of the engine and for generating an electrical signal representative of an output signal supplied by the oxygen sensor;

first servo simulating means for simulating the operation of a first electromechanical device controlled by an automobile engine control system; and second servo simulating means for simulating the operation of a second electromechanicl device controlled by the automobile engine control system whereby the apparatus is useful for testing and calibrating a feedback and automatic idle speed control system for the automobile.

2. Apparatus as set forth in claim 1 wherein the signal generating means includes means for changing the frequency of the electrical signal representing engine revolutions so the signal at any one time represents the revolutions per minute of one of a plurality of multi-cylinder engines.

3. Apparatus as set forth in claim 2 wherein the signal generating means includes a voltage controlled oscillator and a frequency divider responsive to signal elements from the oscillator.

4. Apparatus as set forth in claim 3 wherein the frequency changing means includes a variable position switch for changing the divisor of the frequency divider, the switch enabling the frequency divider to produce an electrical signal whose frequency, at any one time, represents the revolutions per minute of one of a 4-cylinder, a 6-cylinder, or an 8-cylinder engine.

5. Apparatus as set forth in claim 3 wherein the starting means includes means for turning the oscillator on and off.

6. Apparatus as set forth in claim 1 wherein the signal generating means includes an oscillator and a frequency divider responsive to signal elements from the oscillator and means responsive to the time period between signal elements for inhibiting the oscillator if the period between signal elements exceeds a predetermined period thereby to simulate shut down of the engine when subjected to an excessive load.

7. Apparatus as set forth in claim 1 wherein the signal generating means includes a voltage controlled oscillator and the control means includes an electrical circuit the output of which is a voltage supplied to the oscillator to control its frequency of operation.

8. Apparatus as set forth in claim 7 wherein the speed means includes a means for varying the amplitude of the output voltage from the electrical circuit as a function of engine acceleration control.

9. Apparatus as set forth in claim 8 wherein the speed means further includes means for varying the amplitude of the output voltage from the electrical circuit as a function of engine rate of deceleration.

10. Apparatus as set forth in claim 9 wherein the speed means comprises a first and a second potentiometer, each interconnected with the electrical circuit, one potentiometer being adjustable to a resistance value representative of engine's acceleration control and the other potentiometer being adjustable to a resistance value representative of the engine's rate of deceleration.

11. Apparatus as set forth in claim 7 wherein the second servo simulating means includes means for simulating an actuator used in an automatic idle speed control for the engine.

12. Apparatus as set forth in claim 11 wherein the actuator used in the automatic idle speed control has an extendible and retractable member and the actuator simulating means includes means for generating an electrical signal whose amplitude is varied in one direction to simulate extension of the member and in the opposite direction to simulate retraction of the member.

13. Apparatus as set forth in claim 12 wherein the actuator simulating means includes an integrator for producing the electrical signal supplied to the electrical circuit to vary the amplitude of the voltage supplied to the oscillator, and means for establishing a rate at which the amplitude of the electrical signal is varied thus to simulate extension or retraction of the actuator member.

14. Apparatus as set forth in claim 1 further including load means for simulating loads placed on the engine.

15. Apparatus as set forth in claim 14 wherein the signal generation means includes a voltage controlled oscillator, the control means including an electrical circuit, the output of which is a voltage supplied to the oscillator to control its frequency of operation, and the load means includes means for varying the amplitude of the voltage supplied to the oscillator by the electrical circuit.

16. Apparatus as set forth in claim 15 wherein the load means includes means simulating an air conditioner load placed on the engine.

17. Apparatus as set forth in claim 15 wherein the load means includes means simulating a transmission load placed on the engine.

18. Apparatus as set forth in claim 1 wherein the first servo simulating means includes means for simulating the operation of a solenoid used in a feedback control system to control the air-fuel ratio of mixture combusted by the engine.

19. Apparatus as set forth in claim 18 wherein the sensing means includes means for simulating the impedance of an oxygen sensor.

20. Apparatus as set forth in claim 19 wherein the sensing means further includes means for developing an electrical signal representative of the amount of oxygen in the constituents of the exhaust of the engine sensed by an oxygen sensor.

21. Apparatus as set forth in claim 1 further including display means for providing a visual indication of the simulated engine's revolutions per minute.

22. Apparatus as set forth in claim 21 wherein the display means includes means for counting signal elements of the electrical signal representing engine revolutions per minute and for displaying the number of signal elements counted.

23. Apparatus as set forth in claim 22 wherein the display means further includes a light emitting diode (LED) display and means for driving the display to display the number of signal elements counted.

24. Apparatus as set forth in claim 21 wherein the display means includes means for converting the frequency of the electrical signal representing engine revolutions per minute to a voltage and a meter for displaying the voltage as an indication of engine revolutions.

* * * * *